US009919449B2

(12) United States Patent
Langkamp

(10) Patent No.: US 9,919,449 B2
(45) Date of Patent: Mar. 20, 2018

(54) METHOD AND DEVICE FOR DRYING, MODELLING AND/OR THERMALLY MODIFYING WOODEN PARTS

(71) Applicant: Jan Langkamp, Enter (NL)

(72) Inventor: Jan Langkamp, Enter (NL)

(73) Assignee: Jan Langkamp, Enter (NL)

( * ) Notice: Subject to any disclaimer, the term of this patent is extended or adjusted under 35 U.S.C. 154(b) by 352 days.

(21) Appl. No.: 14/367,380

(22) PCT Filed: Dec. 21, 2012

(86) PCT No.: PCT/NL2012/050915

§ 371 (c)(1),
(2) Date: Jun. 20, 2014

(87) PCT Pub. No.: WO2013/095142

PCT Pub. Date: Jun. 27, 2013

(65) Prior Publication Data

US 2014/0349012 A1 Nov. 27, 2014

(30) Foreign Application Priority Data

Dec. 23, 2011 (NL) ..... 2008037

(51) Int. Cl.
*B27K 3/02* (2006.01)
*B27K 5/00* (2006.01)
(Continued)

(52) U.S. Cl.
CPC ..... *B27K 3/0271* (2013.01); *B27K 5/0085* (2013.01); *B27K 5/0095* (2013.01);
(Continued)

(58) Field of Classification Search
CPC ..... F26B 2210/16
See application file for complete search history.

(56) References Cited

U.S. PATENT DOCUMENTS 3,928,677 A 12/1975 Anthony
4,013,809 A 3/1977 Marocco
(Continued)

FOREIGN PATENT DOCUMENTS

CA 2001139 10/1990
CN 2759742 2/2006
(Continued)

OTHER PUBLICATIONS

Machine Translation of EP 1612016A1.*
(Continued)

*Primary Examiner* — David P Turocy
(74) *Attorney, Agent, or Firm* — Oppedahl Patent Law Firm LLC

(57) ABSTRACT

The invention relates to a method for drying, modelling and/or thermally modifying wooden parts, comprising the steps of: a) arranging the wooden parts in a bath; b) filling the bath with a liquid, for instance paraffin or (linseed) oil, wherein the wooden parts are sealed from the ambient air by the liquid; c) the liquid being heated for some time, preferably between 100° C. and 300° C., for the purpose of drying, modelling and/or thermally modifying the wooden parts; d) removing the wooden parts from the bath. The invention also relates to a device for performing the method according to the invention for drying, modelling and/or thermally modifying wooden parts, comprising:—a bath adapted to receive the wooden parts, which bath is intended to receive a liquid such as paraffin or (linseed) oil—heating means for heating the liquid. Finally, the invention relates to a covering and rack as parts of the device according to the invention.

18 Claims, 2 Drawing Sheets

(51) Int. Cl.

| | |
|---|---|
| ***B27M 1/02*** | (2006.01) |
| ***F26B 3/18*** | (2006.01) |
| ***F26B 9/00*** | (2006.01) |
| ***F26B 25/06*** | (2006.01) |

(52) U.S. Cl.

CPC ..... *B27M 1/02* (2013.01); *F26B 3/18* (2013.01); *F26B 9/006* (2013.01); *F26B 25/06* (2013.01); *F26B 2210/16* (2013.01)

(56) References Cited

U.S. PATENT DOCUMENTS

| | | | | |
|---|---|---|---|---|
| 4,971,840 | A | 11/1990 | Boho | |
| 6,634,118 | B2 * | 10/2003 | Chen | F26B 7/00 34/412 |
| 7,739,829 | B2 * | 6/2010 | Chen | A01M 1/2094 34/299 |
| 2005/0223590 | A1 * | 10/2005 | Erickson | F26B 7/00 34/518 |
| 2008/0263890 | A1 | 10/2008 | Picard | |

FOREIGN PATENT DOCUMENTS

| | | | | |
|---|---|---|---|---|
| DE | 2034208 | | 3/1972 | |
| DE | 19829037 | | 1/2000 | |
| DE | 102004020729 | | 11/2004 | |
| DE | 202004021063 | | 12/2006 | |
| EP | 1612016 | A1 * | 1/2006 | B27K 3/0214 |
| EP | 1813401 | | 12/2011 | |
| FR | 2870476 | | 11/2005 | |
| GB | 1023640 | | 3/1966 | |
| GB | 1181246 | | 2/1970 | |
| GB | 1318076 | | 5/1973 | |
| GB | 1454250 | | 11/1976 | |
| GB | 1512549 | | 6/1978 | |
| JP | 2004066797 | | 3/2004 | |
| KR | 20020003471 | | 1/2002 | |
| NL | 7109491 | | 1/1972 | |
| NL | 7800304 | | 7/1978 | |
| NL | 9001103 | | 12/1991 | |
| PL | 170682 | | 1/1997 | |
| WO | 9723327 | | 7/1997 | |
| WO | 03/004952 | | 1/2003 | |
| WO | 03004952 | | 1/2003 | |
| WO | 2005025824 | | 3/2005 | |

OTHER PUBLICATIONS

PCT International Searching Authority; The International Search Report and Written Opinion; dated Aug. 28, 2013; 19 pages.

Netherlands Patent Office; Dutch Search Report; dated Apr. 16, 2012; 5 pages.

* cited by examiner

METHOD AND DEVICE FOR DRYING, MODELLING AND/OR THERMALLY MODIFYING WOODEN PARTS

TECHNICAL FIELD

The invention relates to a method for drying, modelling and/or thermally modifying wooden parts, comprising the steps of:

a) arranging the wooden parts in a bath;

b) filling the bath with a liquid, for instance paraffin or (linseed) oil, wherein the wooden parts are sealed from the ambient air by the liquid;

c) the liquid being heated for some time, preferably between 100° C. and 300° C., for the purpose of drying, modelling and/or thermally modifying the wooden parts;

d) removing the wooden parts from the bath.

The order of steps a) and b) can be reversed here.

BACKGROUND ART

The method according to the preamble is known in the field and is described in, among others, the American patent application U.S. Pat. No. 4,971,840. The known method is used to dry wood, wherein the temperature of the liquid is held just above 100° C. At this temperature the water will drain out of the wood, after which wood remains after a time with a water percentage of less than 5%. The known method can also be used to thermally modify the wood, wherein the wood can optionally be first dried with the known method. The thermal modification takes place by subjecting the wood to a temperature between 130° C. and 220° C., wherein it is important that the wood be placed in a low-oxygen environment.

Known applications for the method are: drying firewood, modelling a wooden part in for instance a chair seat, and producing sustainable wood as substitute for hardwood which is used, among other purposes, as garden timber and facade cladding.

The known method has the advantage that the method entails the wooden parts being placed in a low-oxygen environment. There is hereby no danger that the wooden parts will combust during the thermal modification.

The known method has the drawback that the liquid is absorbed by the wood. The treated wood can hereby not be painted and so is certainly not suitable for use as door/window frame wood.

If the treated wood lies in the outside air there is also a chance of the liquid draining out of the wood. In many cases a liquid is used which is solidified at room temperature, such as paraffin. Once the paraffin has drained out of the wood and then solidified, dirt may begin to adhere thereto.

DISCLOSURE OF THE INVENTION

The invention has for its object to provide a method according to the preamble which does not have the above stated drawbacks, but does have the advantage that the wooden parts are placed in a low-oxygen environment. The method according to the invention has the feature for this purpose that step a) comprises the sub-steps of:

a1) placing a liquid-excluding covering of heat-conducting material over the wooden parts such that in the covering an air pressure is created which ensures that contact between the liquid and the wooden parts is avoided as far as possible during steps b), c) and d);

a2) holding the covering in position during steps b), c) and d).

Applying the liquid-excluding covering prevents the contact between the wooden parts and the liquid in an effective manner. The gases, such as for instance water vapour, coming out of the wood during drying, modelling or thermally modifying of the wooden parts will leave the covering via an underside due to the overpressure created in the covering, and enter the liquid. The heat of the liquid is transmitted directly to the wooden parts by manufacturing the covering from a material which has good temperature-conducting properties. As a result of the upward pressure to which the covering immersed in the liquid is subjected it is necessary for the covering to be held in position during steps b), c) and d). With the method according to the invention it is possible to precisely control the discolouring of the wooden parts, since the method provides a homogenous heat distribution.

In step a1) the wooden parts are preferably first placed on an elevation. This further reduces the chance of the liquid and the wooden parts coming into contact with each other. This elevation can be arranged in the bath. The elevation may also form part of a rack in which the wooden parts and covering are placed.

In order to increase the productivity of the method according to the invention, step a1) comprises the further steps of:

a1-1) placing further wooden parts on a positioned covering;

a1-2) placing a further covering over the further wooden parts of step a1-1;

a1-3) performing steps a1-1) and a1-2) repeatedly until a desired height has been reached; and wherein in step a2) all coverings are held in position during steps b), c) and d).

The bath can in this way be filled with the wooden parts in economic manner, wherein the contact with the liquid is avoided as far as possible for each wooden part. Because the wooden parts and the coverings are stacked alternately, all coverings can be held in position by holding only the uppermost covering in position.

In order to increase the productivity still further it is of course also possible to make several such stacks, which are placed adjacently of each other in the bath.

In a first preferred embodiment of the method according to the invention, in step a2) a covering is in each case chosen wherein the upper side of the covering has a shape corresponding to the upper side of the placed wooden parts and the upper side of the covering lies against the upper side of the wooden parts. This has the advantageous effect that the contact surface area between the covering and the wooden parts is in this way enlarged and results in a more efficient heat conduction. The heat of the liquid is transmitted directly to the wooden parts by the covering, whereby the heat can penetrate further into the wooden parts. It is hereby possible to dry, model and/or thermally modify larger wooden parts. Because the covering is held in place, the wooden parts in the covering are also held in position. This drastically reduces the chance of the wood deforming.

In this first preferred embodiment a covering is preferably chosen in step a1) wherein the upper side of the covering has a shape corresponding to the underside of the placed wooden parts and the upper side of the covering lies against the underside of the wooden parts.

In order to further reduce the chance of deformation, in step c) the shrinkage of the wood of the wooden parts is taken into account when holding the covering in position. The wooden parts shrink as a result of the loss of moisture in the wood. This can be compensated by taking this shrinkage into account when holding the covering in position.

In step c) the sides of one or more coverings can be pressed against the wooden parts placed under the covering. The heat of the liquid is in this way transmitted directly from the covering to the sides of the wooden parts.

Manufacturing the covering from a deformable metal such as aluminium enables the covering to adjust locally to the shape of the wooden parts. For instance in the case of knots in the wooden parts, which do not shrink, or hardly so, the covering will be deformed at the position of a knot. The covering does after all lie against the wood around the knot, whereby the wood around the knot is dried, modelled and/or thermally modified.

A profile and/or profiling can be placed against one or more sides of the wooden parts. This profile can be arranged permanently or by means of a profile plate which can be removed. During thermal modification of the wooden parts this profile can be transferred in inventive manner to the wooden parts, for instance for aesthetic purposes.

During cooling the cooling wooden parts have a suction action, whereby the liquid level under the covering may begin to rise. In order to prevent this, gas or steam is preferably injected into the bath under the wooden parts during cooling. This can be achieved in simple manner by introducing water into the bath on the underside of the bath. The water will immediately change into steam due to the high temperature of the liquid and enter the covering via the underside thereof. The wooden parts are hereby cooled further, with the advantage that the liquid vapours, such as paraffin vapour, enter the end surfaces of the wooden part. This is particularly advantageous for outdoor applications of the wooden parts, since the end surfaces are moisture-proof as a result of the paraffin vapour impregnation.

In a very economic embodiment of the method, cool liquid is introduced into the bottom of the bath during cooling and hot liquid is discharged at the top of the bath. The hot liquid can be stored in a thermally insulated container and can be reused, for instance in order to perform the method again. The hot liquid can of course also be used for the purpose of heating another space. The cool liquid will be heated by the cooling wooden parts. In the case where the wooden parts are thermally modified, the phenomenon occurs above 200° C., depending on the type of wood, that the wooden parts generate more heat than is being supplied. This heat can advantageously be absorbed into the cool liquid via the covering, which is preferably manufactured from aluminium.

In step a2) the covering can be held in position during steps b), c) and d) by placing a sufficiently heavy weight on the uppermost covering. This can also be achieved by means of clamping means or pressing means which engage on one or more coverings.

The clamping force can also be utilized for the purpose of modelling the wooden parts, arranging a profile on the wooden parts and/or compacting the wood structure of the wooden parts.

Possible knots in the wooden parts can be sunk into the wood before step a), wherein a layer, for instance 2 mm, is cut off the knot. This reduces the chance of the knot charring or splitting apart when the above stated method is performed.

The invention also relates to a device for performing the above described method for drying, modelling and/or thermally modifying wooden parts, comprising:

a bath adapted to receive the wooden parts, which bath is intended to receive a liquid such as paraffin or (linseed) oil heating means for heating the liquid.

In addition to the above described features, the inventive device also has the feature that the device comprises a number of liquid-excluding coverings, which coverings are adapted to be stacked with interposing of the wooden parts, wherein the height of the covering corresponds at least to the height of the wooden parts to be covered;

comprises means for holding the placed coverings in position.

The bath is preferably provided on the underside with an elevation adapted to support the wooden parts. After placing of the covering the liquid can no longer come into contact with the wooden parts.

In a first preferred embodiment of the device according to the invention the upper side of the covering has a shape corresponding to the upper side of the wooden parts. The upper side of the covering hereby lies properly against the upper side of the wooden part, whereby the contact surface area between the covering and the wooden parts is maximized. The heat of the liquid is hereby transmitted to the wooden parts in efficient manner.

For the same reason as mentioned above, it is desirable for the upper side of the covering to have a shape corresponding to the underside of the wooden parts.

In order to compensate for the shrinkage of the wood during heating, the means for holding the placed coverings in position are preferably controllable.

Providing the inner side and/or the outer side of the upper side of the covering with a profile makes it possible to provide the wooden parts with a profile or profiling.

In a second preferred embodiment of the device the bath is provided on the underside with a supply opening for supplying cool liquid and is provided on the upper side with a discharge opening for discharging hot liquid. It is hereby possible during cooling to discharge the hot liquid and replace it with cool liquid.

A plate is preferably laid on each overlapping or on at least the uppermost covering in order to better combat warping of the wooden parts.

Said elevation can also be arranged on a rack on which the wooden parts, alternated with a covering, are arranged. The rack can be filled with the wooden parts and the covering outside the bath, after which the rack is placed in the bath. The clamping means are preferably integrated into the rack.

Finally, the invention relates to a covering and rack as parts of the above described device.

In a preferred embodiment of the covering according to the invention the covering is provided on one or more undersides of the sides with one or more discharge pipes adapted to discharge gases coming out of the wood. The discharge pipes have a height such that the outer end protrudes above the liquid level in the bath. This largely prevents the gases coming out of the wood from contaminating the liquid in the bath.

The covering can also be provided with one or more releasable lips intended to lie against the sides of the wooden parts. The heat of the liquid can reach the sides of the wooden parts better and/or more quickly due to the lips.

The method according to the invention is preferably monitored by placing thermocouples in or close to the wooden parts for the purpose of monitoring the temperature of the wooden parts and/or by placing an air humidity meter above the bath for the purpose of measuring the amount of water vapour coming out of the wooden parts.

BRIEF DESCRIPTION OF THE DRAWINGS

The invention will be further described with reference to a number of figures, in which.

BEST MODE FOR CARRYING OUT THE INVENTION

Figure 1:
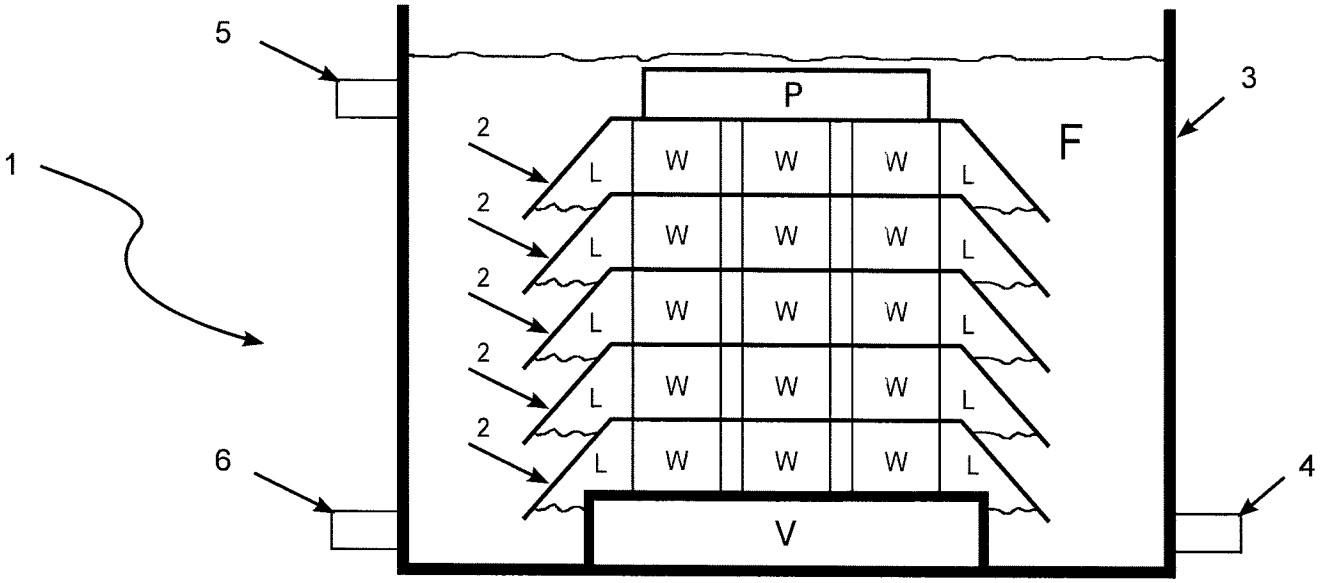
FIG. 1 shows a preferred embodiment of the device according to the invention in which the wooden parts have been placed in the device.

FIG. 1 shows a preferred embodiment of device 1 according to the invention in which the wooden parts W have been placed in device 1. The device comprises a bath 3 adapted to receive the wooden parts W. Bath 3 is provided with supply opening 4 for supplying liquid F and discharge opening 5 for discharging liquid F. The liquid F used cannot combust of itself and has a low evaporation, such as paraffin or (linseed) oil. Device 1 also comprises heating means for heating the liquid F. These are however not drawn, since the heating of liquid is a commonplace operation for the skilled person. The heating means can be adapted to heat the liquid directly. The heating means can also be arranged in or inside the one or more coverings, for instance thermal plates placed between the wooden parts. Device 1 comprises an elevation V which is arranged in optionally releasable manner on the bottom of bath 3. The elevation V is preferably manufactured from a grating such that liquid F can enter the space in elevation V. The first series of wooden parts W to be dried, modelled and/or thermally modified is placed on elevation V. Once the first series of wooden parts W has been placed, a covering 2 is placed over this series. Further series of wooden parts W are then placed alternating with further coverings 2. This is preferably repeated until the resulting stack reaches the vicinity of the edge of bath 3. Arranged on uppermost covering 2 are means for holding the placed coverings 2 in position, for instance a heavy weight P. Bath 3 is then filled with liquid F via supply opening 4.

Because the coverings are liquid-excluding, no liquid can penetrate into the space in covering 2, although air cannot escape from this space either. The result is that the air pressure under covering 2 ensures that the wooden parts W do not come into contact with the liquid F.

The liquid F is then heated to a known temperature and for a known period of time using means known in the field for the purpose of drying, modelling and thermally modifying wooden parts.

Once the drying, modelling and/or thermal modifying of the wooden parts has been completed the wooden parts W are cooled, wherein the hot liquid F is discharged via discharge opening 5 and cool liquid F is simultaneously supplied via supply opening 4. The cool liquid F will absorb the heat still present in the wood W. This heat can then be reused.

Following cooling of the wooden parts W all liquid F is removed from bath 3 via discharge opening 6. After the weight P has been removed, all coverings 2 and wooden parts W can then be taken out of device 1.

Figure 2D:
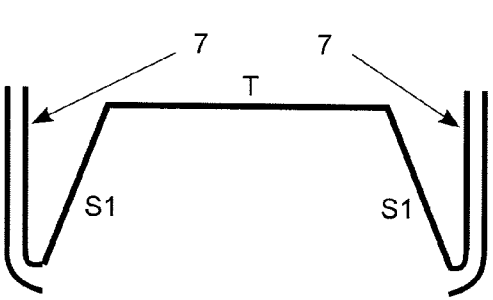
FIGS. 2A, 2B, 2C and 2D show different views and embodiments of the covering according to the invention.
Figure 2B:
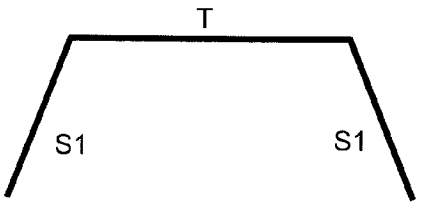
Figure 2A:
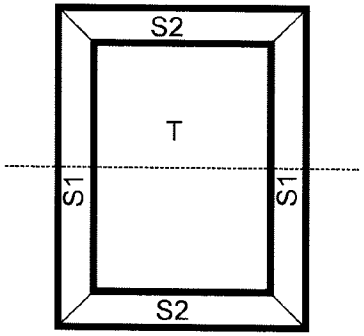

FIG. 2A is a top view of the preferred embodiment of the covering according to the invention. The top view is formed by the upper side T, two downward sloping long sides S1 and two downward sloping short sides S2.

FIG. 2B shows a cross-section of the preferred embodiment of the covering according to the invention along the line in FIG. 2A. This cross-section shows the upper side T and two downward sloping long sides S1.

Figure 2C:
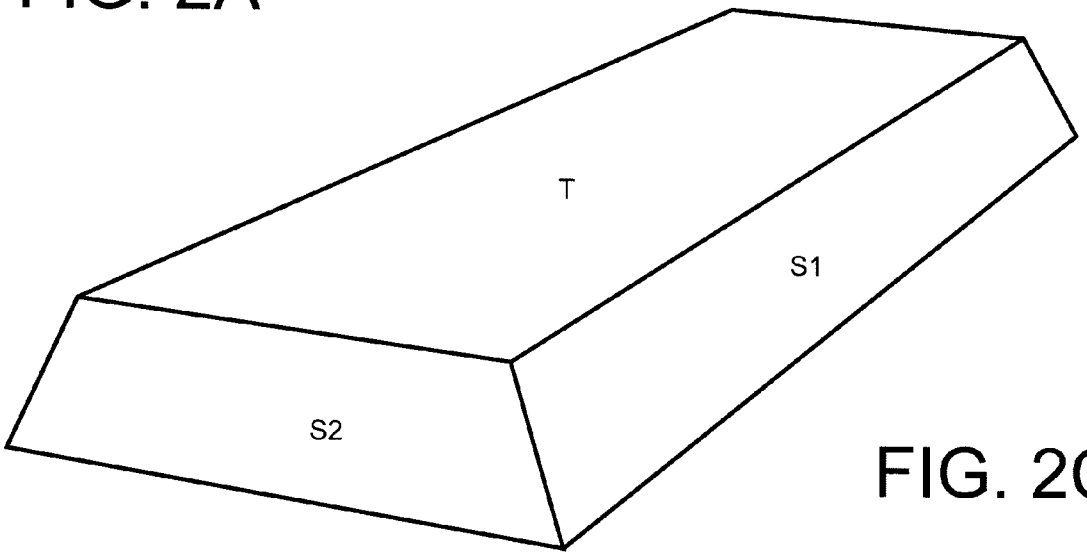

FIG. 2C is a perspective view of the preferred embodiment of the covering according to the invention in which the upper side T and the sides S1 and S2 are shown. The upper side T is preferably manufactured from a thin-walled metal which is easily deformable, such as aluminium or soft copper.

It is recommended that the transitions between S1 and S2, between S1 and T and between S2 and T are gas and liquid-tight so that no air can escape from the space under the covering and no liquid can enter this space while the method according to the invention is being performed.

FIG. 2D shows an embodiment of the covering in which the covering is provided with discharge pipes. These discharge pipes are arranged on the underside of the covering and have a height such that the discharge pipe protrudes above the liquid level. This largely prevents the gases coming out of the wooden parts from contaminating the liquid in the bath. There is a random number of discharge pipes. The discharge pipe can also be provided with a non-return valve for the purpose of preventing return flow of possibly condensed, contaminated gases.

The above developed embodiment shows a single layer with wooden parts under a covering. The patent application is not however limited hereto. It is expressly also possible for the wooden parts to be stacked under the covering. It is also possible here for (thermal) plates to be placed between the wooden parts.

The inventive method produces a homogeneously dried, modelled and/or thermally modified wood, whereby the method qualifies for known certification, such as KOMO certification.

Using the inventive method and device it is possible to thermally modify thick wooden parts without the wooden parts being deformed or the liquid being absorbed into the wooden parts. The method hereby produces for instance wood suitable for manufacturing door/window frame parts, wherein the wooden parts may not be warped, must have a relatively great thickness, the wooden parts must preferably have a high durability class (for instance durability class 1 or 2 in accordance with NEN-EN 350-1) and must be suitable for painting.

In an economic preferred embodiment of the device according to the invention the one or more baths for application of the method according to the invention are provided with heat-exchanging means for absorbing the heat of the bath, wherein the heat-exchanging means comprise a heat-absorbing liquid or a gas. The liquid in the one or more baths can have a differing temperature, but can also have the same temperature. The wooden parts which have undergone a heat treatment in a bath are placed with covering in a subsequent bath for cooling purposes, wherein the liquid in this bath has a lower temperature than the liquid in the preceding bath. The heat of the wooden parts is hereby transmitted in simple manner to the liquid in the bath, which then transmits the heat to the heat-exchanging means.

The heat-exchanging means are preferably formed by a heat-exchanging bath filled with a heat-absorbing liquid or a gas. The baths are placed in the heat-exchanging bath.

In addition, the heat-exchanging means can be formed by one or more conduits and/or reservoirs which are placed round or in the one or more baths. The conduits and/or reservoirs here comprise the heat-absorbing liquid.

In another economic preferred embodiment of the device according to the invention, wherein energy is also recovered, the device is provided with a plurality of successive baths, wherein the liquid in the subsequent bath has a higher temperature than in the preceding bath. By immersing the wooden parts with covering in successive baths, the wooden parts will in each case absorb heat and become warmer. After drying and/or modification/modelling has taken place at higher temperatures (between for instance 100 and 300 degrees), the wooden parts with covering can be immersed in increasingly colder baths so that the heat absorbed by the wooden parts is returned to the liquid in the baths, whereby an enormous energy-saving is realized. It has been found in practice that the energy-saving increases with the number of baths.

Each bath is preferably provided with two compartments separated by liquid-tight separating walls, wherein both compartments are filled with a liquid. The first compartment is preferably filled with a cheaper liquid than the second compartment. The first compartment is adapted to heat the wooden parts with covering placed in the first compartment. The second compartment is adapted to cool the wooden parts with covering placed in the second compartment. The liquid-tight separating walls are adapted here to transmit the heat absorbed by the liquid from the second compartment to the first compartment.

Each bath is preferably provided with heat-exchanging means as is described above.

The steam and possible other gases released during drying and/or thermal modifying of the wooden parts can be recycled within and/or outside the process using known heat exchanger techniques.

In a further preferred embodiment of the covering according to the invention the covering is provided with one or more supply pipes for adding gases (for instance acetic anhydride) to be suctioned in via the underside of the covering and/or to keep the pressure high enough during cooling so as to avoid liquid contact.

During the process of drying and/or thermal modifying of the wooden parts reservoirs with means for supplying gas, such as acetic anhydride or paraffin, floating under the covering or arranged on the inner side of the covering, can also supply vapour to be suctioned into the wooden parts.

The invention claimed is:

1. A method for heat treatment of wooden parts by transmitting heat to wooden parts in a low-oxygen environment, comprising the steps of:

a) arranging the wooden parts in a bath;

b) filling the bath with a liquid;

c) the liquid being heated for some time for the purpose of drying or thermally modifying the wooden parts;

d) removing the wooden parts from the bath;

wherein, step a) comprises the sub-steps of:

a1) placing a liquid-excluding covering with an open underside of heat-conducting solid material over the wooden parts;

a2) holding the covering in position during steps b), c) and (d); and step b) comprises the sub-step of:

b1) enclosing the open underside of the covering with the liquid thereby creating a liquid level under the covering that encloses a volume of air under the covering, whereby the volume of air is contained under the covering by the liquid and the covering such that an air pressure is created under the covering which ensures that contact between the liquid and the wooden parts is avoided during steps b), c) and d).

2. A method as claimed in claim 1, wherein in step a1) the wooden parts are first placed on an elevation.

3. A method as claimed in claim 1, wherein step a1) comprises the further steps of:

a1-2) placing further wooden parts on a positioned covering;

a1-3) placing a further covering over the further wooden parts of step a1-2);

a1-4) performing steps a1-2) and a1-3) repeatedly until a desired height has been reached; and wherein in step a2) all coverings are held in position during steps b), c) and d).

4. A method as claimed in claim 1, wherein in step a1):

a covering is in each case chosen wherein the upper side of the covering has a shape corresponding to the upper side of the placed wooden parts; and the upper side of the covering lies against the upper side of the wooden parts.

5. A method as claimed in claim 1, wherein in step a1): a covering is in each case chosen wherein the upper side of the covering has a shape corresponding to the underside of the placed wooden parts; and the upper side of the covering lies against the underside of the wooden parts.

6. A method as claimed in claim 1, wherein in step c) the shrinkage of the wood is taken into account when holding the covering in position.

7. A method as claimed in claim 1; wherein in step c) the sides of one or more coverings are pressed against the wooden parts placed under the covering.

8. A method as claimed in claim 1, wherein a profile and/or profiling is placed against one or more sides of the wooden parts.

9. A method as claimed in claim 1, wherein the liquid is cooled in controlled manner before step d) is performed.

10. A method as claimed in claim 9, wherein gas is injected into the bath under the wooden parts during cooling.

11. A method as claimed in claim 10, wherein steam is injected into the bath under the wooden parts during cooling.

12. A method as claimed in claim 9, wherein cool liquid is introduced into the bottom of the bath during cooling and hot liquid is discharged at the top of the bath.

13. A method as claimed in 1, wherein in step a2) holding the covering in position during steps b), c) and d) is achieved by placing a sufficiently heavy weight on the uppermost covering.

14. A method as claimed in claim 1, wherein in step a2) holding the covering in position during steps b), c) and d) is achieved by a clamping device.

15. A method as claimed in claim 14, wherein the clamping force is also used for the purpose of modelling the wooden parts, arranging a profile on the wooden parts, preventing splitting in the wooden parts and/or compacting the wood structure of the wooden parts.

16. A method as claimed in claim 1, wherein knots are first sunk into the wooden parts before step a).

17. A method as claimed in claim 1, wherein in step c) the liquid is heated to between 100° C. and 300° C.

18. A method as claimed in claim 1, wherein the liquid used in step b) is paraffin or oil or linseed oil.

* * * * *